US008371968B2

(12) United States Patent
Gazzara et al.

(10) Patent No.: US 8,371,968 B2
(45) Date of Patent: Feb. 12, 2013

(54) SPORTS RACQUET STRUCTURE

(75) Inventors: Roberto Gazzara, Venice (IT); Mauro Pinaffo, Camposampiero (IT); Michele Pozzobon, Fossalunga di Vedelago (IT); Mauro Pezzato, Treviso (IT)

(73) Assignee: ABG Prince Italy SRL (IT)

( * ) Notice: Subject to any disclaimer, the term of this patent is extended or adjusted under 35 U.S.C. 154(b) by 0 days.

(21) Appl. No.: 12/736,282

(22) PCT Filed: Apr. 3, 2009

(86) PCT No.: PCT/IB2009/051423

§ 371 (c)(1),
(2), (4) Date: Jan. 24, 2011

(87) PCT Pub. No.: WO2009/125329

PCT Pub. Date: Oct. 15, 2009

(65) Prior Publication Data

US 2011/0201461 A1 Aug. 18, 2011

(30) Foreign Application Priority Data

Apr. 7, 2008 (EP) ..... 08154163

(51) Int. Cl.
*A63B 49/02* (2006.01)
*A63B 59/00* (2006.01)

(52) U.S. Cl. ..... 473/527; 473/524; 473/516

(58) Field of Classification Search ..... 473/524, 473/527, 516

See application file for complete search history.

(56) References Cited

U.S. PATENT DOCUMENTS

| | | | | |
|---|---|---|---|---|
| 881,266 | A * | 3/1908 | Thompson et al. | 473/524 |
| 7,204,770 | B2 * | 4/2007 | Mithieux | 473/527 |
| 7,309,299 | B2 * | 12/2007 | Pezzato et al. | 473/540 |
| 2003/0069096 | A1 * | 4/2003 | Lin | 473/521 |
| 2006/0160641 | A1 * | 7/2006 | Mithieux | 473/527 |
| 2006/0172828 | A1 * | 8/2006 | Pezzato et al. | 473/527 |
| 2011/0201461 | A1 * | 8/2011 | Gazzara et al. | 473/527 |

FOREIGN PATENT DOCUMENTS

| | | | |
|---|---|---|---|
| DE | 101 61 835 | A1 * | 7/2003 |
| WO | WO 2010069560 | A1 * | 6/2010 |

* cited by examiner

*Primary Examiner* — Raleigh W. Chiu
(74) *Attorney, Agent, or Firm* — R. Blake Johnston, Esq.; DLA Piper US LLP

(57) ABSTRACT

A sports racquet comprising a handle portion, a paddle portion, which is provided with at least a solid ball striking surface, and a neck portion, which rigidly connects said handle portion and said paddle portion. The paddle portion comprises at least a first cavity having a first longitudinal axis, which is substantially unperpendicular to said main reference plane.

17 Claims, 15 Drawing Sheets

SPORTS RACQUET STRUCTURE

Figure 1:
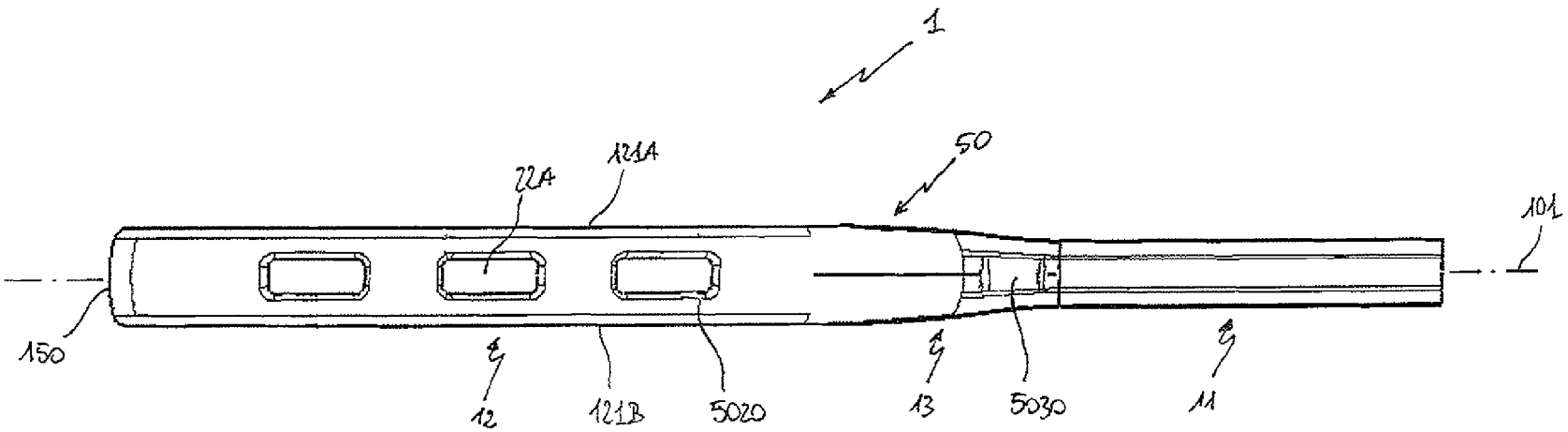
Figure 2:
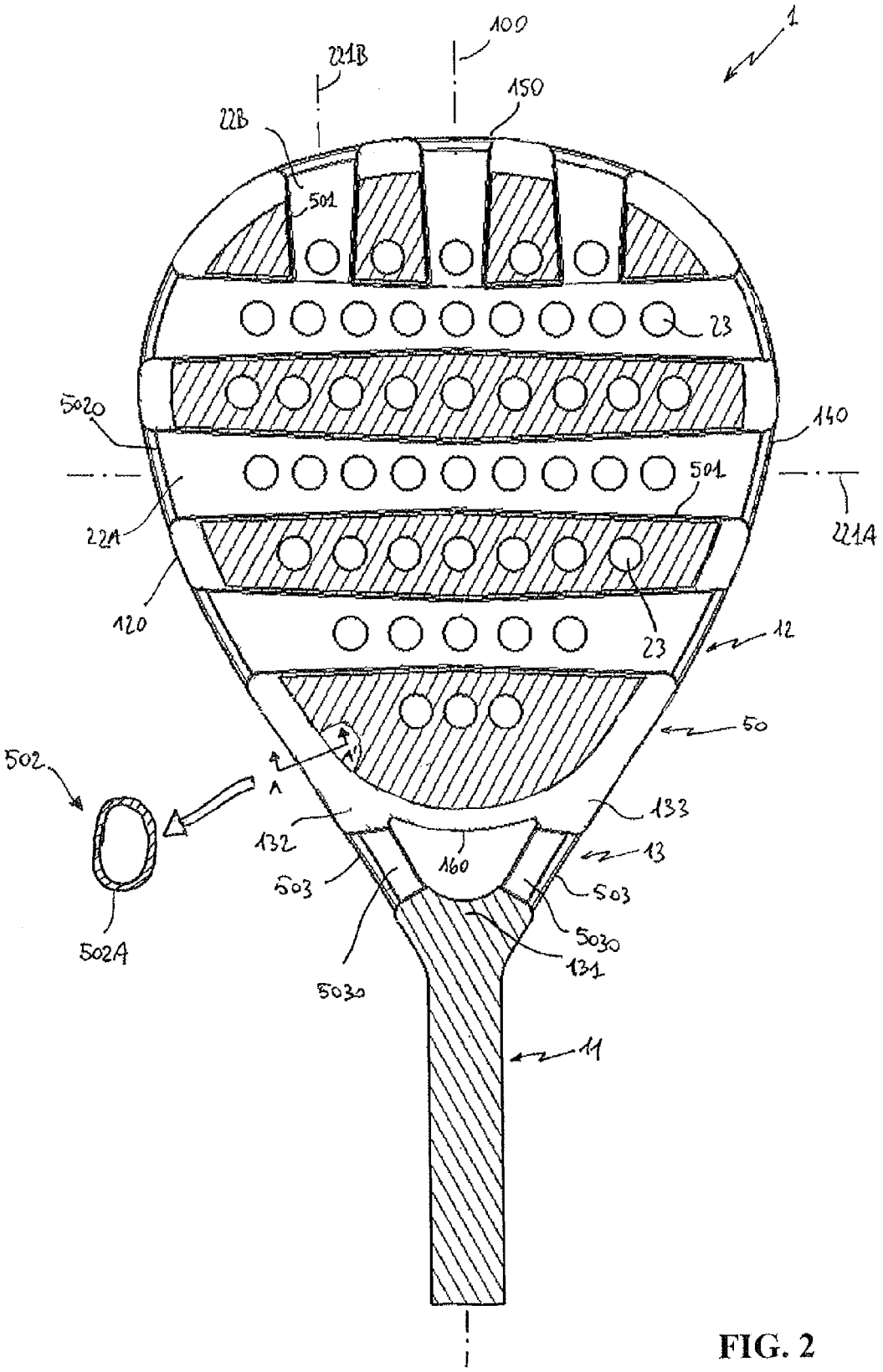
Figure 3:
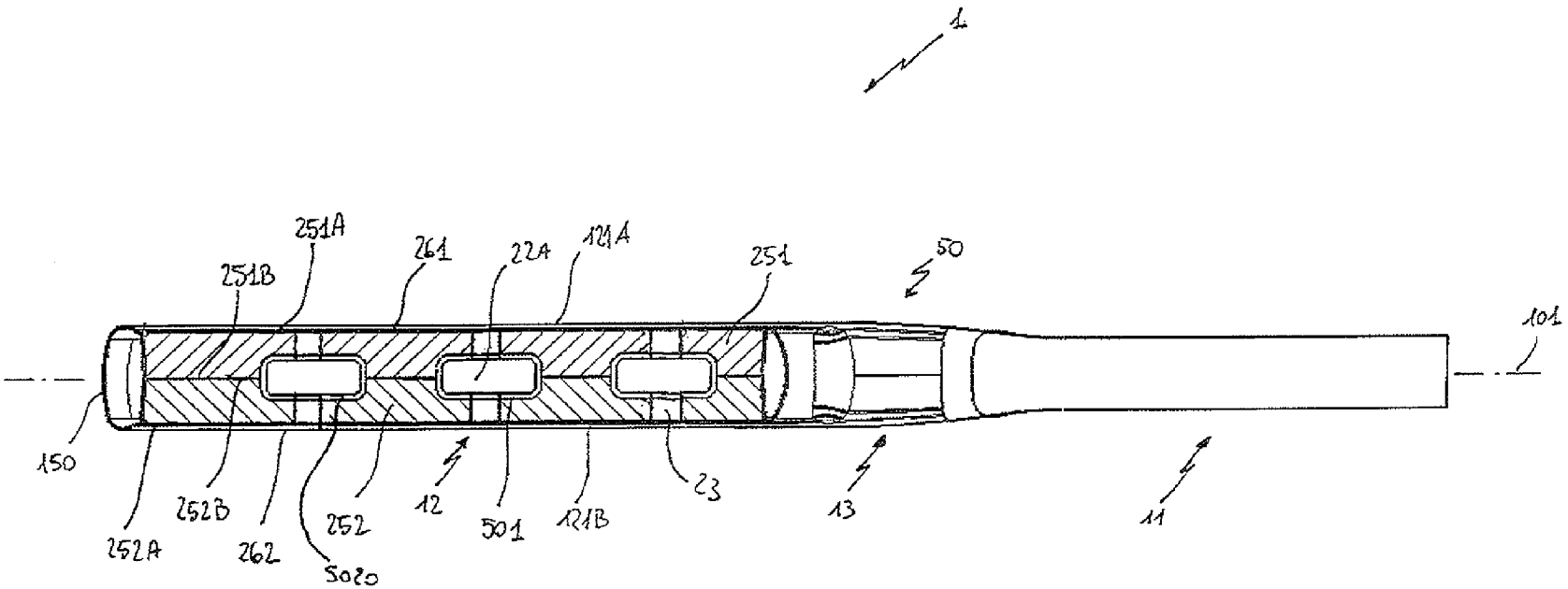
Figure 4:
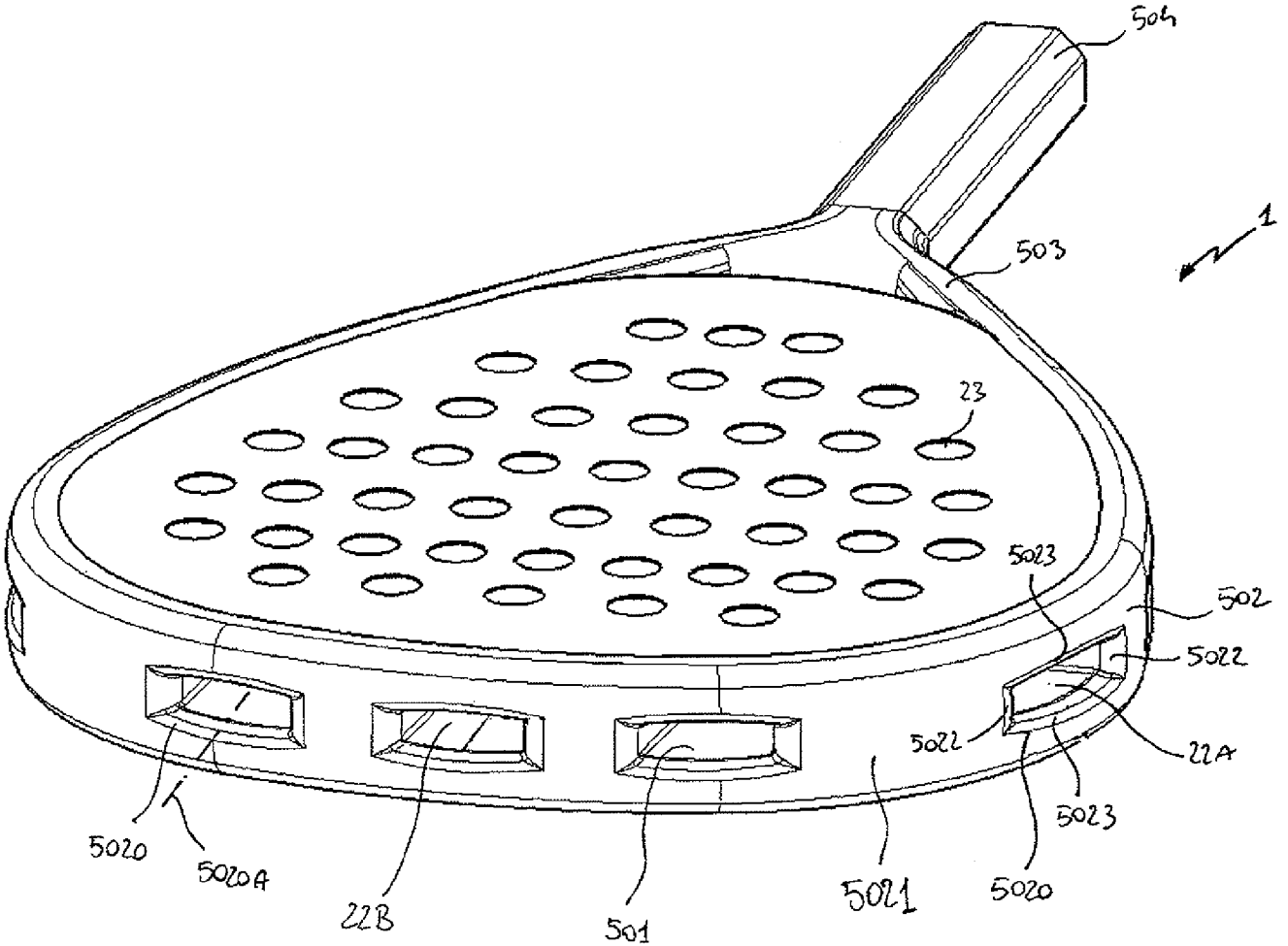

The present invention relates to an improved sports racquet structure.

More particularly, the present invention concerns a sports racquet structure that is particularly suitable for use in platform tennis, paddle tennis, beach tennis, table tennis and, more generally, for any racquet sports activity, in which a solid racquet surface is used for striking the ball. Racquets provided with at least a solid surface for striking the ball are widely known. Commonly, these sports racquets are known as "paddle racquets".

Basically, their structure comprises a handle portion that is solidly connected to a neck portion that is, in turn, solidly connected to a paddle portion comprising a forehand and a backhand solid surface for striking the ball.

Said paddle portion is generally formed of a sandwich of layers including some internal softer core layers and cover layers that are bonded externally to said core layers, at both the racquet faces, so as to form the mentioned striking ball solid surfaces.

Also, the paddle portion may comprise a reinforcing external rim and a plurality of holes running perpendicularly to the ball striking surface. No external rim or perpendicular holes are generally provided in table tennis racquets while these elements are typically present in paddle racquets addressed to paddle tennis, beach tennis or platform tennis.

The size, the thickness and the material of each racquet element may vary depending on the activity, for which the paddle racquet is conceived. Thus, by way of example, a table tennis racquet will have much smaller size and thickness and completely different materials with respect to a beach tennis racquet.

Paddle racquets have been subjected to some improvements during years.

Some technical solutions, such as those disclosed in patent documents WO93/14825 and U.S. Pat. No. 4,353,550 have been proposed in the attempt of achieving an improved control in placing the shot.

Other technical solutions, such as that one disclosed in patent application WO80/02511, have been introduced with the aim of improving the ball striking efficiency and reducing the user's fatigue, particularly when playing outdoor.

U.S. Pat. No. 3,879,250 described an example of a traditional method for manufacturing a paddle racquet structure.

Despite of these efforts, the paddle racquets that are nowadays available are still facing some remarkable drawbacks.

A first disadvantage is due to their not negligible overall heaviness that is quite detrimental to the user's comfort during the playing activity.

Furthermore, known paddle racquets present relatively low performances in terms of aerodynamics. The racquet swinging is thus more tiring with less user's comfort, more difficulties in controlling of the ball and less power in striking the ball.

In addition, the structural design of known paddle racquets, with particular reference to the paddle portion, cannot be easily changed or adapted to specific user's needs, apart from the mentioned natural differences characterizing each type of racquet. This fact does not allow the introduction in the market of a wide range of product lines, each tailored to a certain class of users.

The structure of a traditional paddle racquet is also quite defective from an aesthetic point of view. Possible aesthetic improvements of the racquet appearance find severe constraints in the traditional known racquet structure and merely consist in the introduction of new writings or colors.

Finally, paddle racquets are nowadays manufactured with industrial processes that are quite time and labor consuming, with relatively high costs.

Thus, there exists a continuing need for improved sports racquet structures with a solid ball striking surface, which have the combined features of light weight and improved striking efficiency, aerodynamics, comfort and manufacturability.

Thus, the present invention provides a sports racquet structure, which is in its more general definition, comprises a handle portion, a neck portion and a paddle portion comprising at least a solid ball striking surface and one or more internal cavities running unperpendicular, preferably parallel, to said ball striking surface.

This novel structure for the paddle portion allows the achievement of remarkable improvements in terms of aerodynamics and reduction of the racquet weight.

The physical characteristics of the racquet structure, such as the weight or inertia momentum, can also be easily tuned according to the user's needs, since it is possible to easily vary the percentage of vacuum space that is present in the paddle portion of the racquet.

The novel structure for the paddle portion further presents itself a remarkable aesthetic character and allows the introduction of completely new solutions for the racquet aesthetics. Finally, the racquet structure, according to the invention, can be manufactured in an easy and efficient manner at low cost with regard to both materials and labor.

Figure 5:
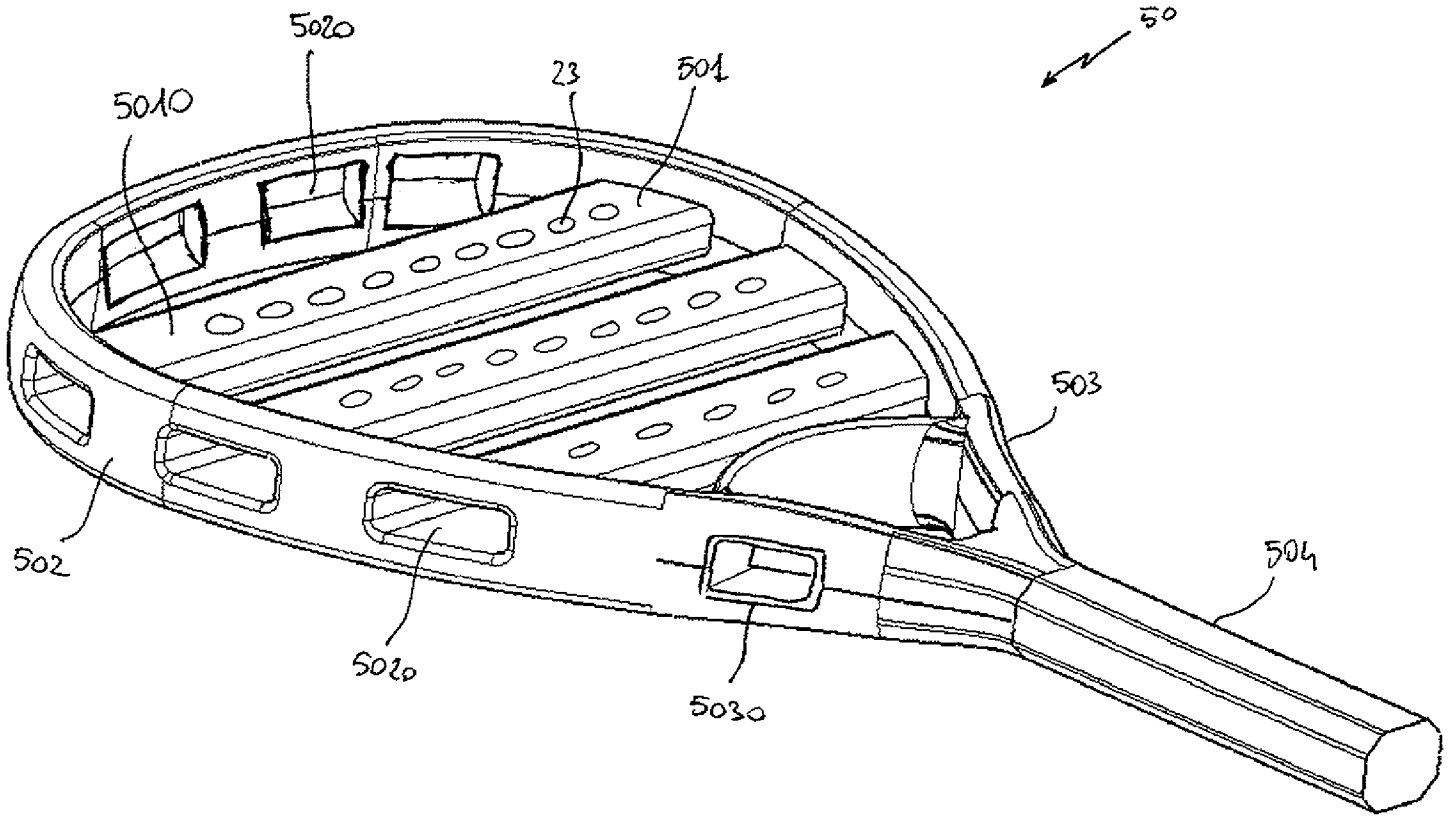
Figure 6:
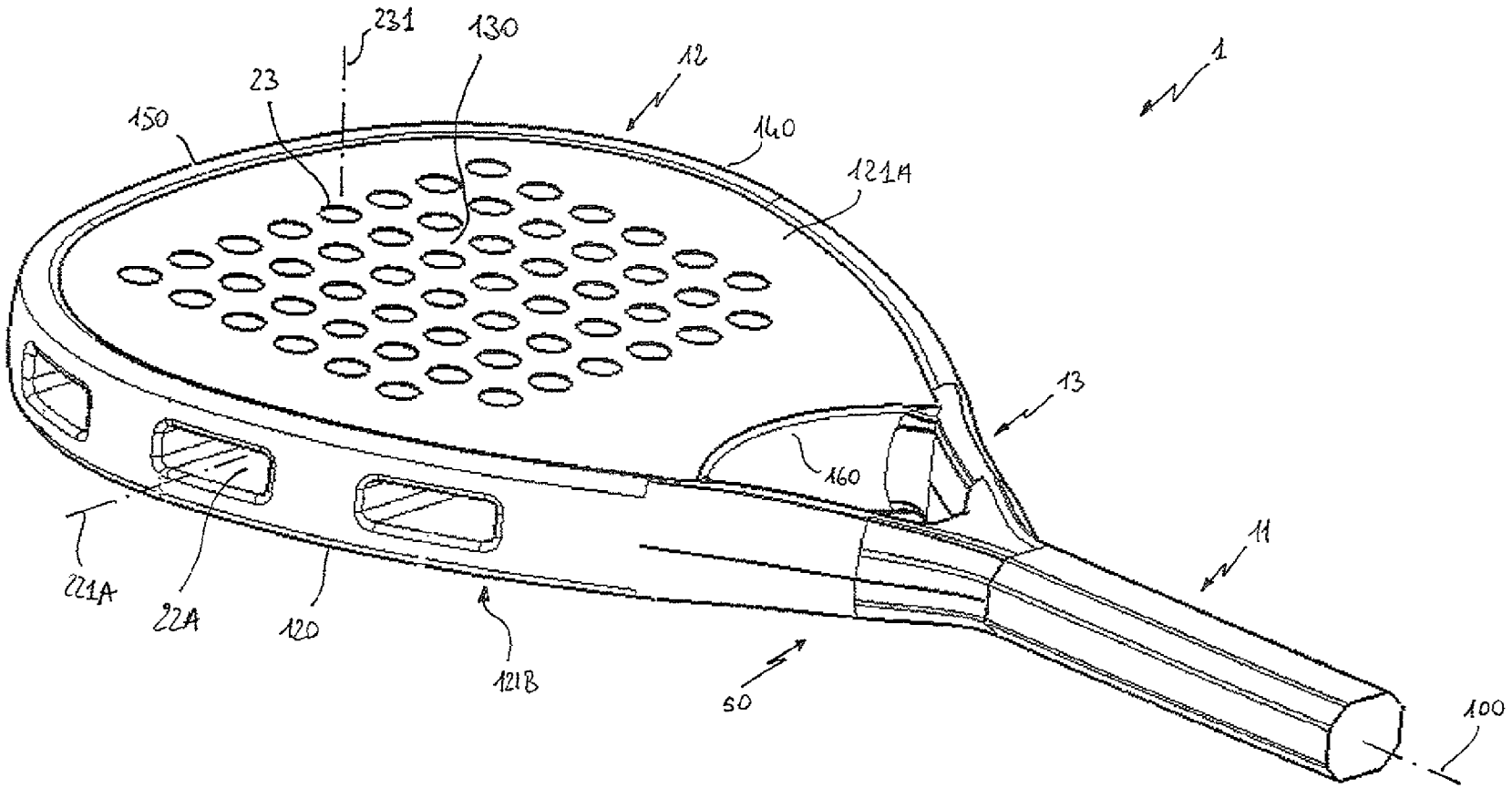
Figure 7:
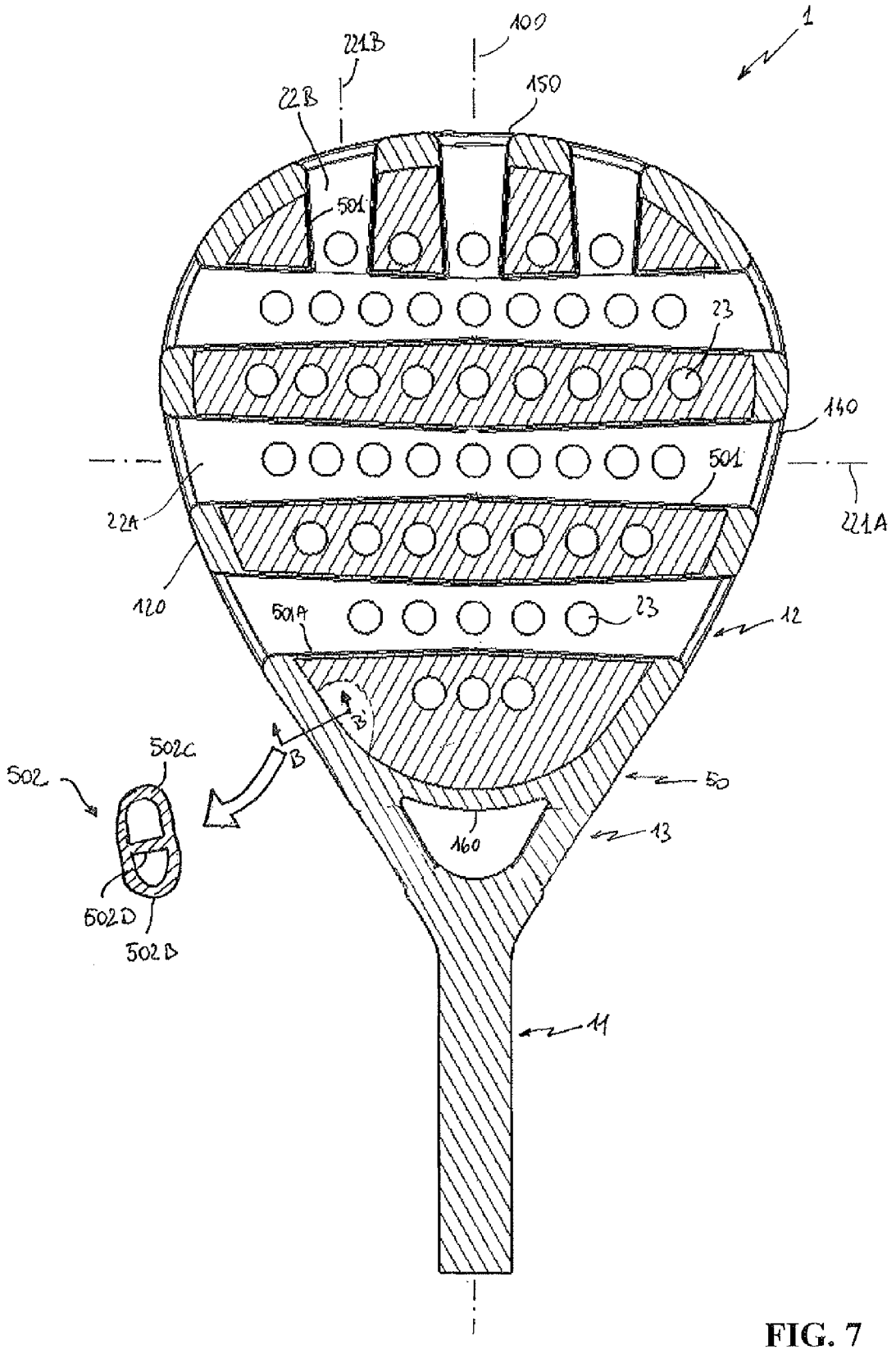
Figure 8:
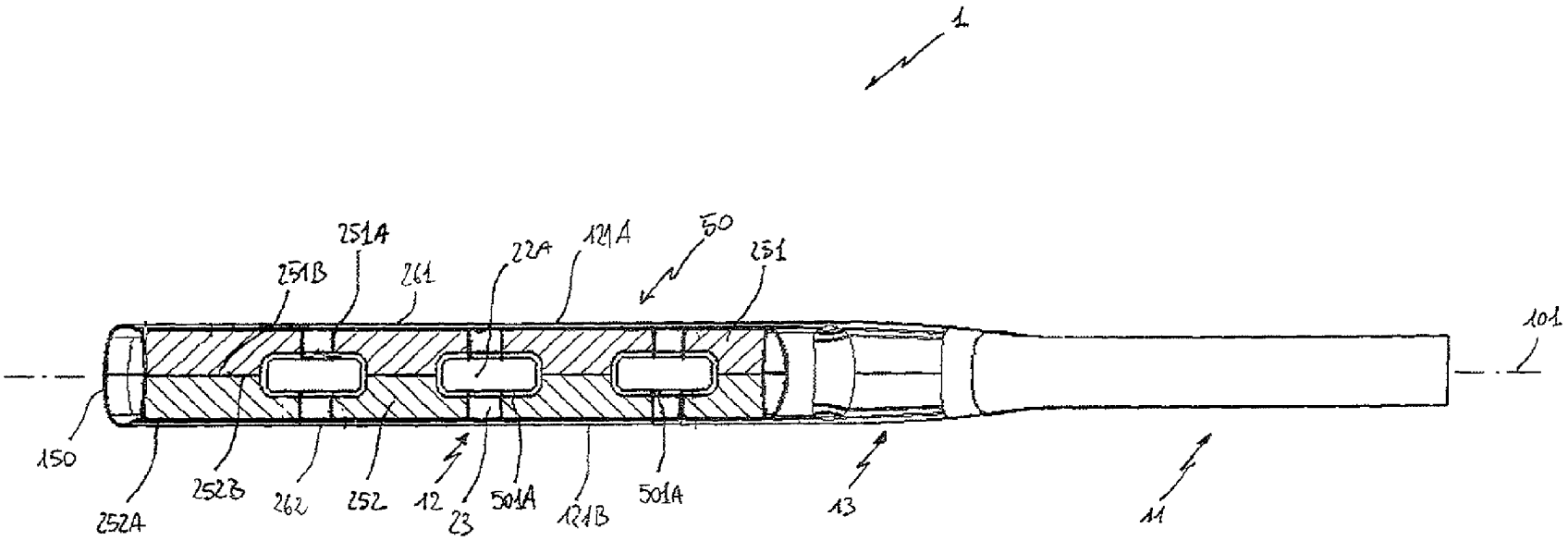
Figure 9:
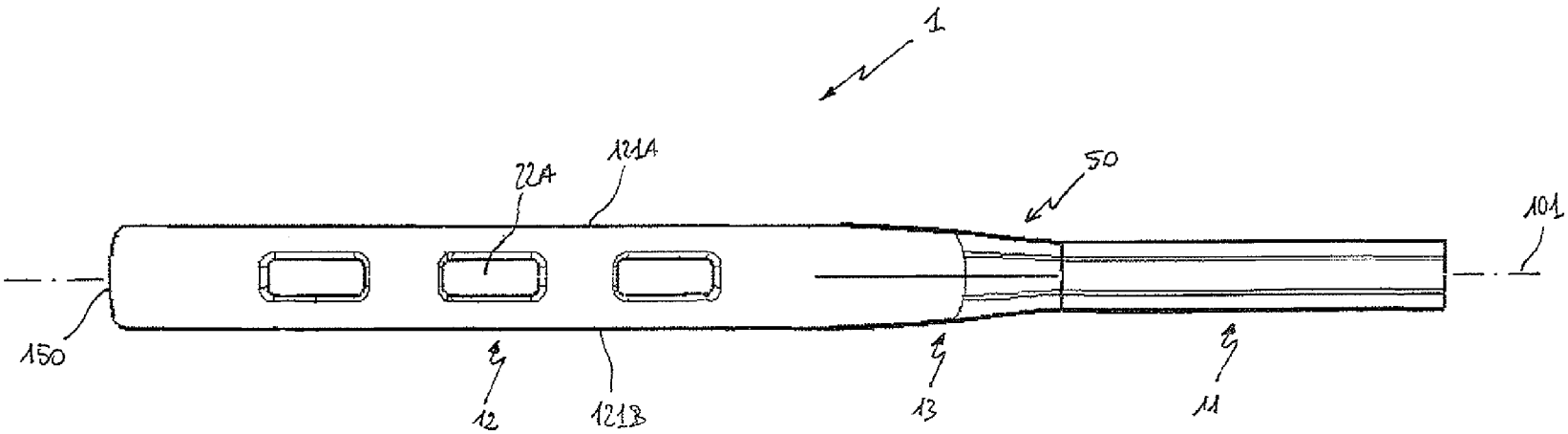
Figure 10:
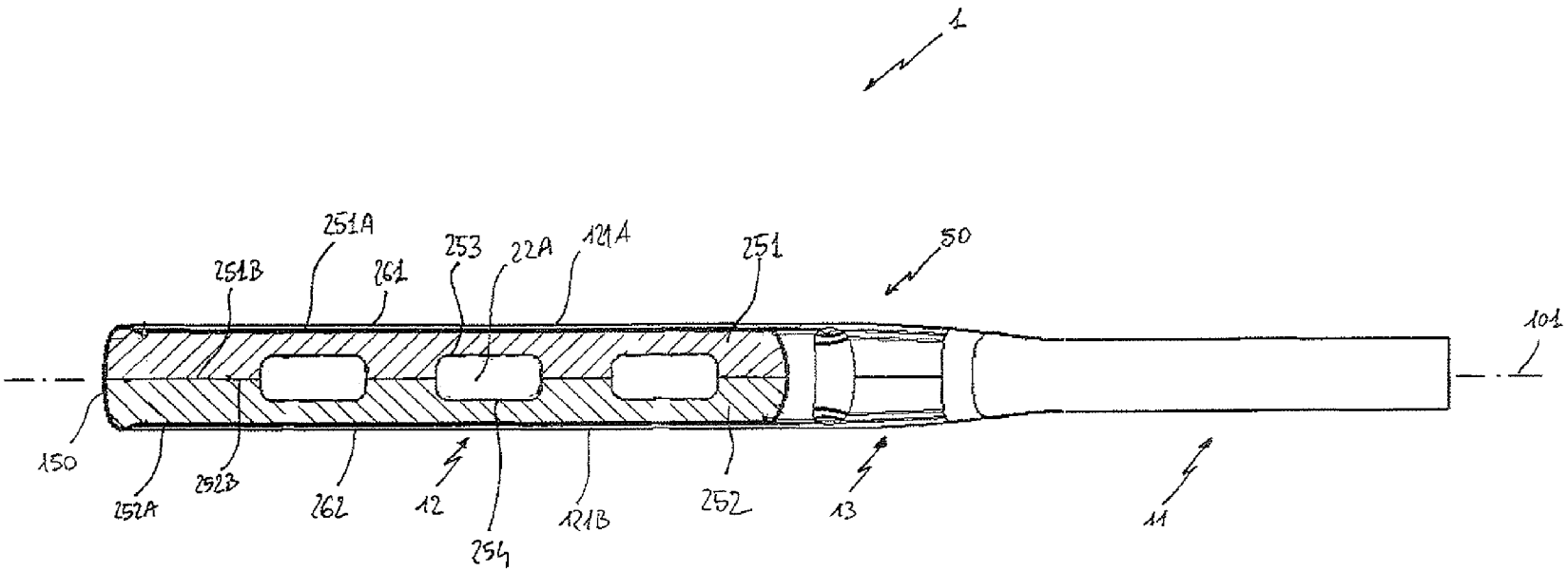
Figure 11:
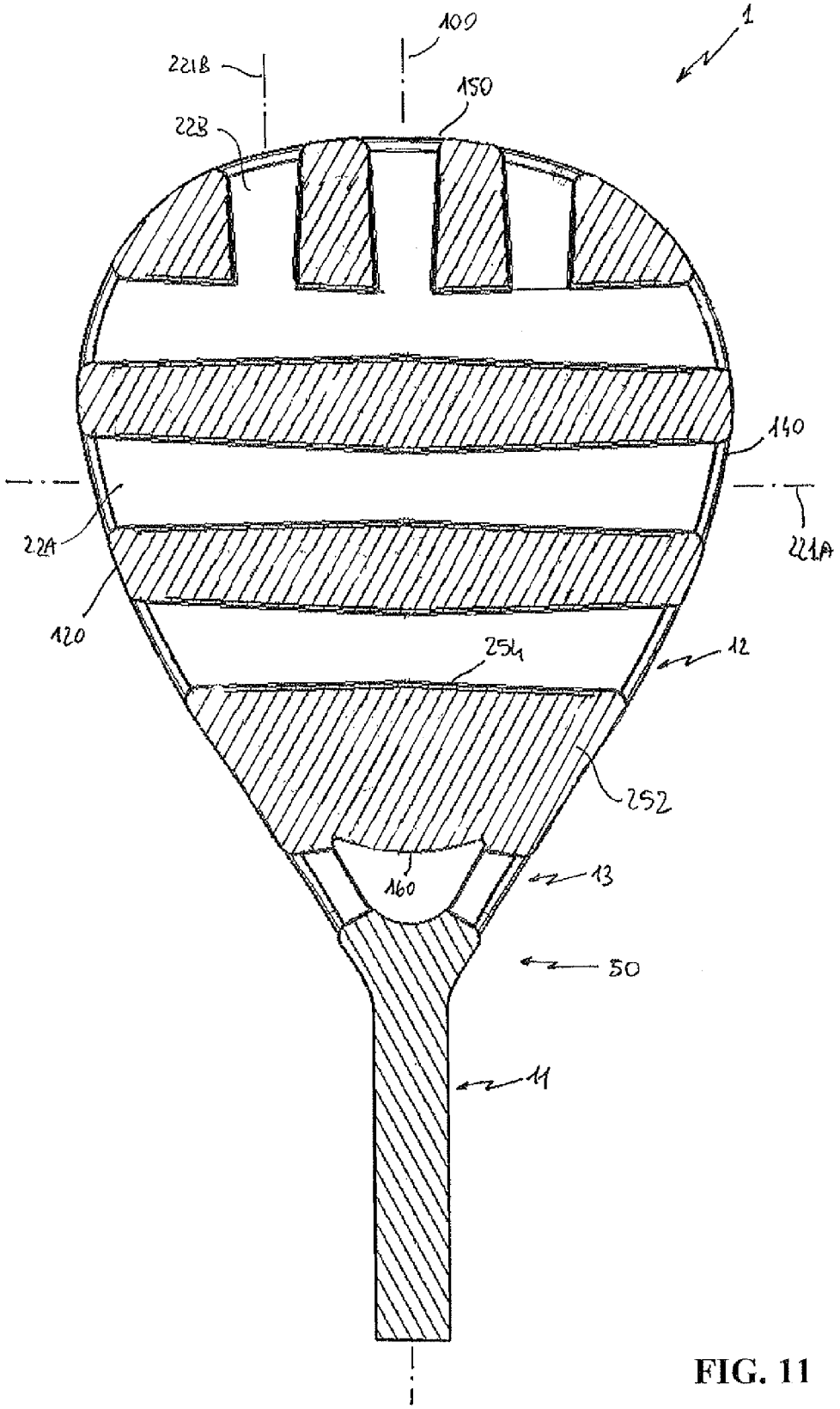
Figure 12:
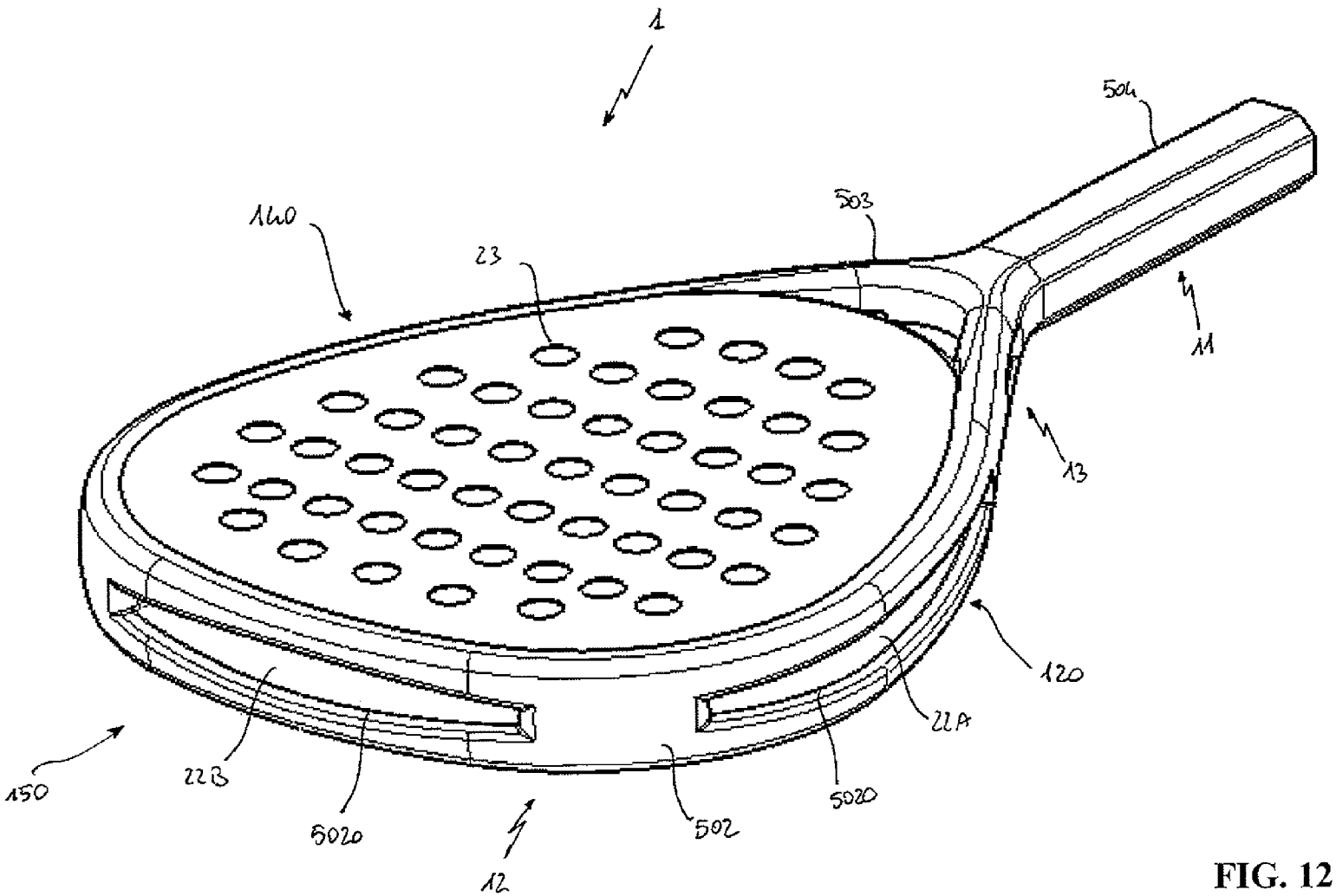
Figure 13:
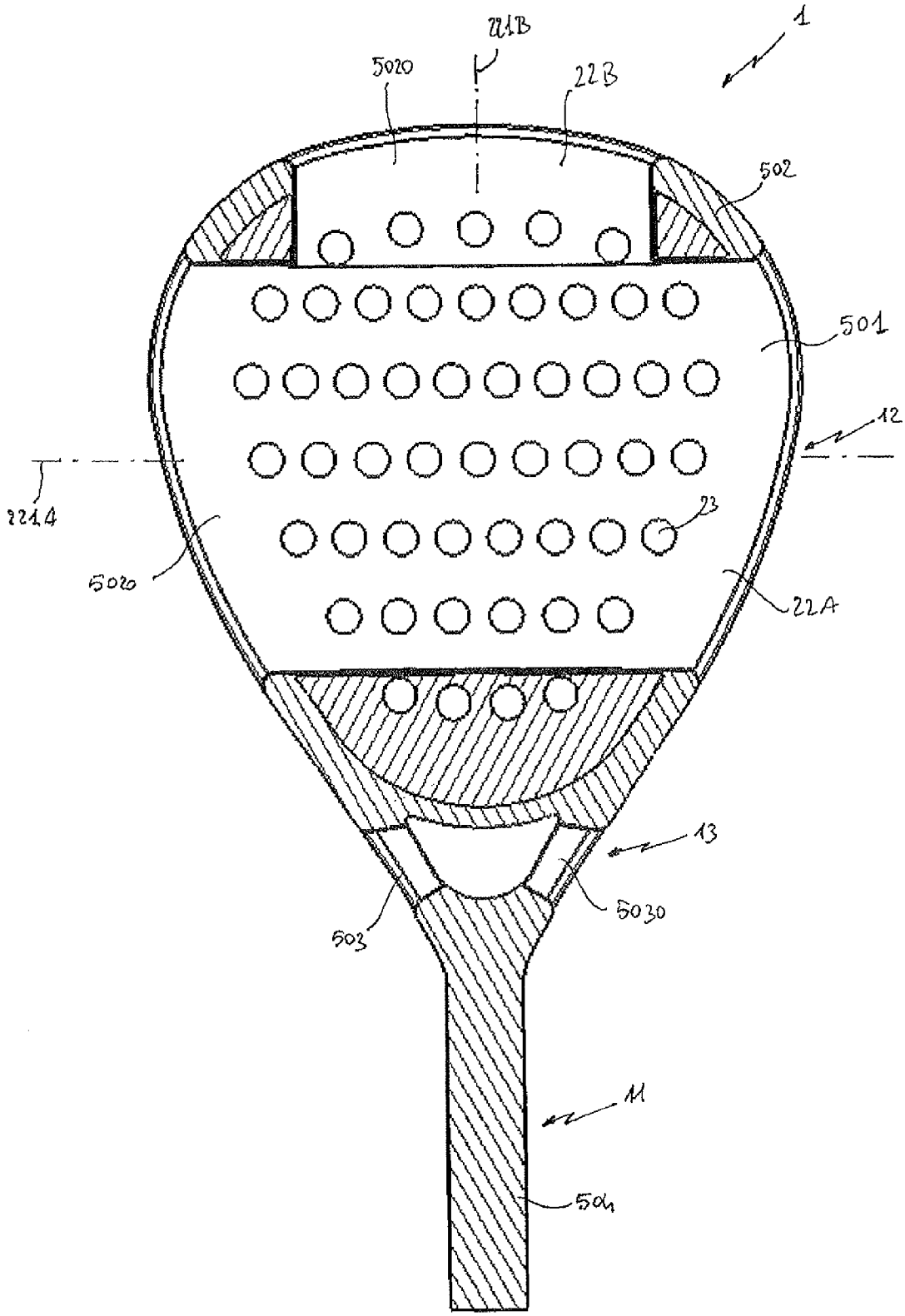
Figure 14:
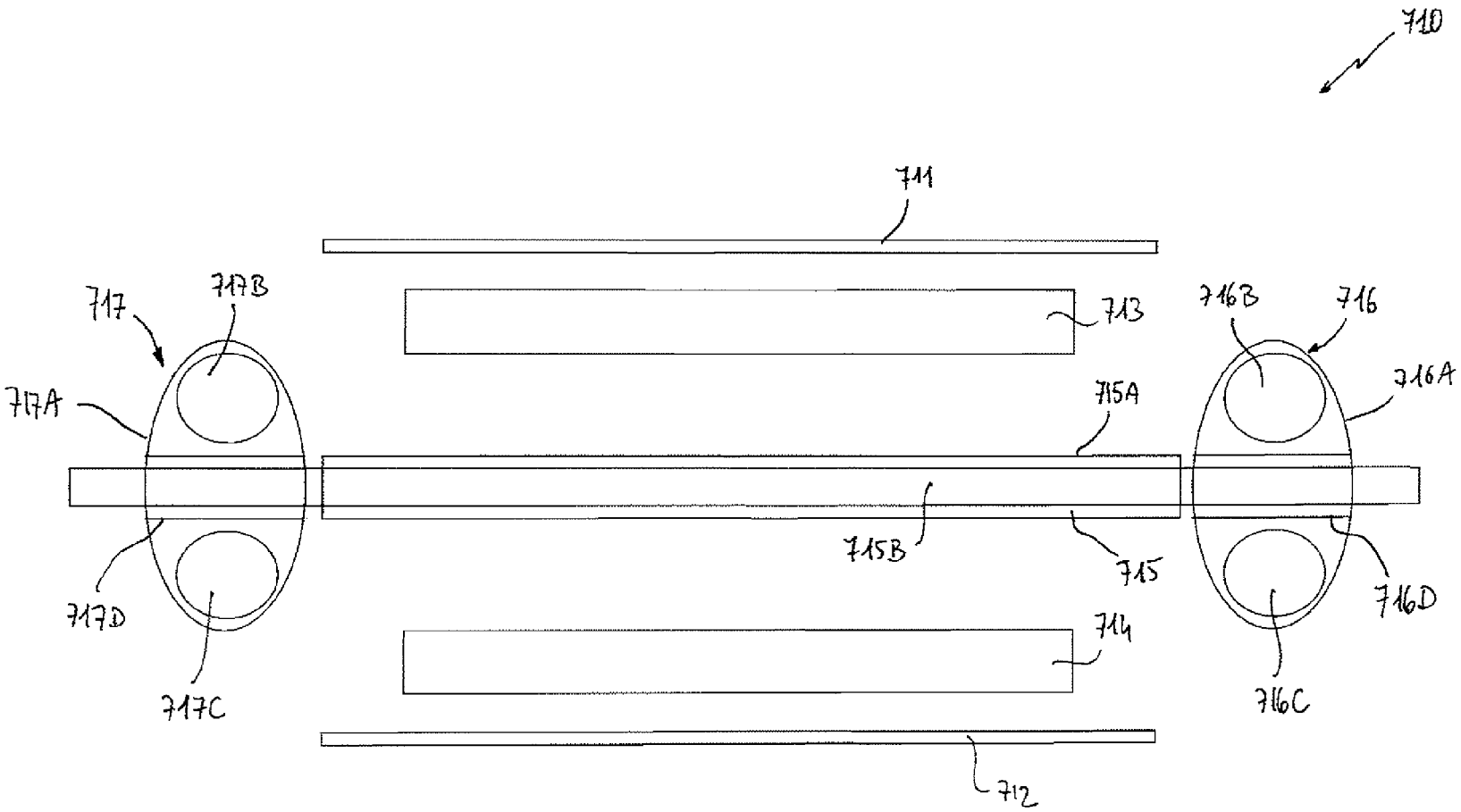
Figure 15:
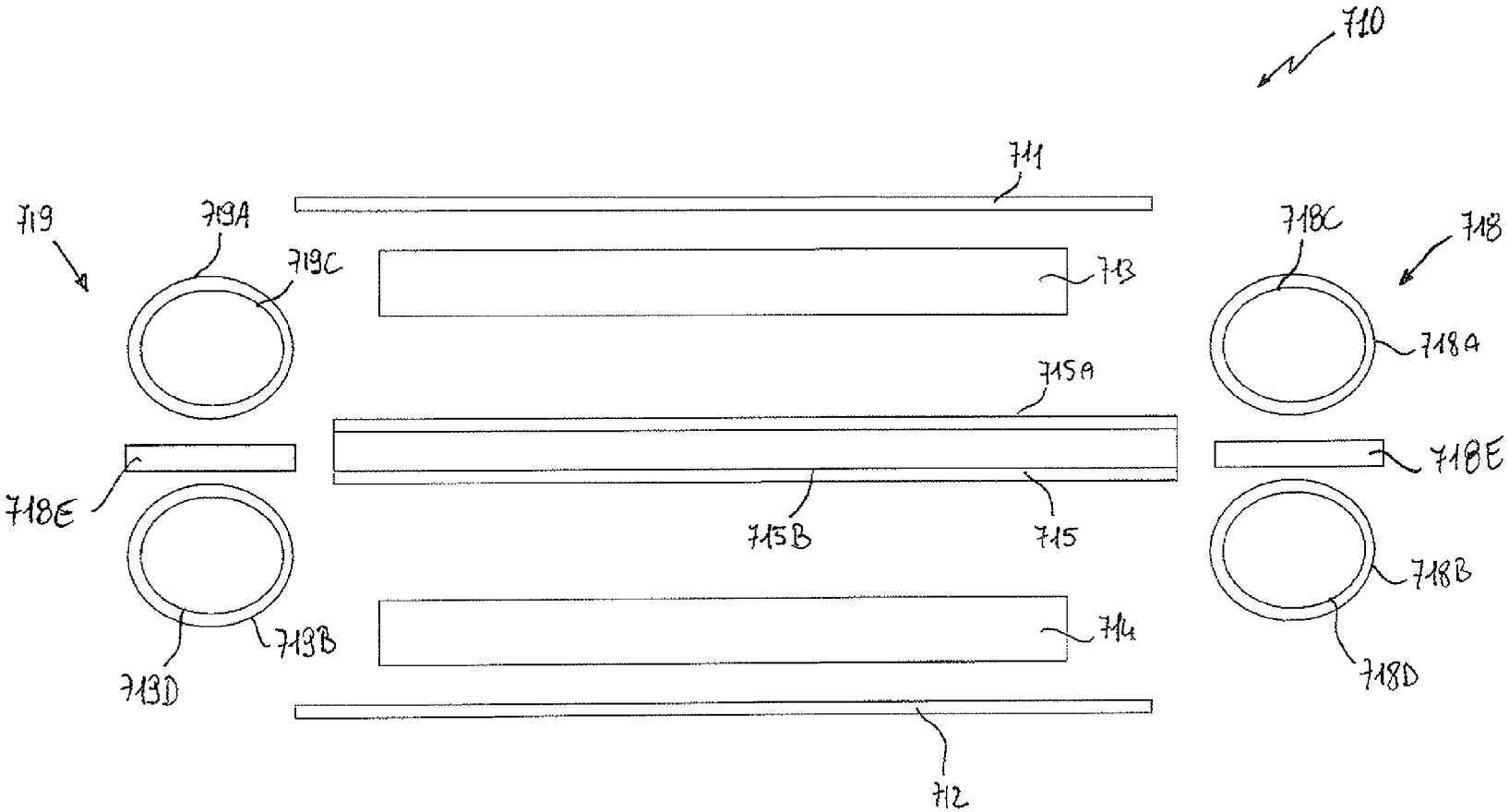

For a better understanding of the invention and its advantages, reference should be made to the accompanying drawings, in which:

FIGS. 1-5 are different perspective and section views of a sports racquet structure, according to the invention, in a first embodiment; and FIGS. 6-8 are different perspective and section views of a sports racquet structure, according to the invention, in a further embodiment; and FIGS. 9-11 are different perspective and section views of a sports racquet structure, according to the invention, in a further embodiment; and FIGS. 12-13 are different perspective and section views of a sports racquet structure, according to the invention, in a further embodiment; and FIG. 14-15 schematically illustrates some possible variants for a method for manufacturing the sports racquet structure, according to the present invention.

Referring to the cited figures, the racquet structure 1, according to the invention, extends along a main reference plane 101 and has a main longitudinal axis 100.

The main longitudinal axis is the main axis 100 of extension of the racquet structure while the reference plane 101 may be a plane of simmetry parallel to the racquet faces.

The racquet structure 1 comprises a handle portion 11, a neck portion 13 and a paddle portion 12 that are solidly connected.

The paddle portion 12 is provided with at least a solid surface for striking a ball. Preferably, the paddle portion 12 comprises two ball striking surfaces 121A and 121B, which are parallel to the main reference plane 101, so as to allow the user to place forehand and backhand shots. From the cited figures, it is evident how the paddle portion 12 comprises different sections such as a bridge section 160 that is proximate to the neck portion 13, a central section 130, a tip section 150 that is opposite to the bridge section 160 (with respect to the central section 130), and two side sections 120 and 140 that are positioned opposite with respect to the main longitudinal axis 100.

Preferably, the paddle portion 12 comprises a first core member 251 that is provided with a first bonding surface 251A and a second bonding surface 251B.

The first bonding surface 251A is bonded to at least a first cover layer 261 forming the first striking ball surface 121A.

The second bonding surface 251B is instead bonded to a third bonding surface 252B of a second core member 252, which comprises also a fourth bonding surface 252A, which is, in turn, bonded to a second cover layer 262 forming the second striking ball surface 121B of the paddle portion 12.

The size, thickness and materials of the core members 251 and 252 may vary according to the needs. Also, they can be substantially monolithic (as shown) or be obtained from different sandwiched layers of various materials.

The core members 251-252 can be made of EVA, Poliurhetane (PU) foam, themoplastic elastomers or another relatively soft material commonly used in racquets addressed to sports such as paddle tennis, beach tennis or platform tennis In table tennis racquets, the core members 251-252 can instead comprise layers of wood alternate with layers of plastic or composite materials.

Also the structural characteristics of the cover layers 261-262 may vary according to the needs.

For example, in paddle tennis, beach tennis or platform tennis racquets they may be advantageously made of composite materials while for table tennis racquets they can comprise layers of rubber or other relatively soft materials.

The paddle portion 12 of the racquet structure 1 comprises one or more first cavities 22A-22B that are unperpendicular with respect to the striking ball surfaces 121A-121B.

Preferably, the cavities 22A-22B are directed substantially parallel to the main reference plane 101, having a first longitudinal axis that is directed along any possible direction parallel to the main reference plane 101.

Further, each of said cavities preferably extends between two different sections 120-160 of the paddle portion 12.

It is apparent how the cavities 22A-22B allow a passage of air that is internal the paddle portion 12, transversal to it and parallel to the ball striking surfaces 121A and 121B.

Preferably, the paddle portion 12 comprises one or more first cavities 22A that have a first longitudinal axis 221A running perpendicularly to the main longitudinal axis 100. The cavities 22A are preferably through cavities extending between the side sections 120 and 140 of the paddle portion 12.

The paddle portion 12 may also comprise one or more first cavities 22B that run along a first longitudinal axis 221B that is parallel to the main longitudinal axis 100. The cavities 22B are advantageously positioned at the tip section 150 and may communicate with the cavities 22A, so as to allow the internal passage of air between the side sections 120 and/or 140 and the tip section 150.

The paddle portion 12 may comprise a plurality of cavities at any of the sections mentioned above, as shown in the embodiments illustrated in FIGS. 1-11.

As an alternative, any of said sections may comprise a single cavity. In the embodiment shown in FIGS. 12-13, single enlarged cavities extend respectively between the sides sections 120-140 and at the tip section 150. Each of said enlarged cavities 22A-22B, covers almost the extension of said sections. This feature furthermore helps the air passage through the paddle portion 12 and provides a dramatic aesthetic effect.

According to the embodiment of the present invention that is shown in FIGS. 9-11, the cavities 22A-22B may be obtained by directly superimposing and bonding the core members 251 and 252. To this aim, the core members 251 and 252 may comprise one or more first and second shaped walls 253 and 254 respectively at the second and third bonding surfaces 251B and 252B.

When the core members 251 and 252 are bonded together, the shaped walls 253-254 face each other and define the first cavities 22A and 22B.

The bonding of the core members 251-252 and of the cover layers 261-262 is obtainable by means of simple molding techniques.

The racquet structure 1 preferably comprises a supporting frame 50, which is advantageously adopted to form and define at least partially one or more of the racquet portions 12-14.

A view of a possible embodiment of the supporting frame 50 as a whole is offered at FIG. 5. Of course, variants of the frame structure are possible according to the needs.

In order to form and define the cavities 23A-23B, the supporting frame 50 may comprise one or more first hollow members 501 that extend through the paddle portion 12.

Preferably, the first members 501 are positioned between the core members 251 and 252, which may be properly shaped at the bonding surfaces 251B and 252B in order to ensure that said bonding surfaces adhere to the external surface 5010 of the first members 501 (FIG. 5).

Each hollow member 501 preferably comprises a single hollow tubular element that is preferably made of a composite material, such as carbon or glass fibers. Other materials such as metals (e.g. Aluminum) or wood can be used.

If composite materials are used, the first members 501 may be obtained by means of a molding process of prepreg tubes having an inflatable bladder inside.

If wood or metal or plastic materials are used, more traditional manufacturing techniques may be chosen.

The supporting frame 50 may also comprise at least a second frame member 502, which defines an external rim that contours at least partially the paddle portion 12.

Said external rim is advantageously provided in sports racquets addressed to sports like paddle tennis, platform tennis and beach tennis, in which the ball impact is relatively strong.

According to a first embodiment of the present invention (FIG. 2), the second frame member is constituted by a single hollow tubolar element 502A, which can be made of a composite material (e.g. carbon fibers) or metals (e.g. Aluminum) or other materials.

As an alternative (FIG. 7), the second member 502 may be formed of two or more tubolar elements 502B and 502C, which are joined together to form a common wall 502D. Both of the tubolar elements 502B-502C are preferably about the same size and, when joined, form a "D" shape.

The wall 502D is interior to the frame member 502 (FIG. 7) and runs parallel to the main reference plane 101, so as to improve the resistance to the structural bending determined by the ball impact.

As a further possible option (not shown), the second member 502 may be formed by more than two tubular elements, which are joined so as to form a common internal wall, e.g. in the form of an "X" or an "Y".

The tubolar elements 502*b* and 502C can be made of a composite material (e.g. carbon fibers) or metals (e.g. Aluminum) or other materials.

As a further alternative, the second member 502 may comprise a strip of metal or wood.

The second frame member 502 is advantageously associated to the first frame members 501 at one or more first frame openings 5020.

The openings 5020 are preferably enlarged cavities (hereinafter referred to as "ports") that pass through the entire frame member 502 along an axis 5020A (FIG. 4) that is substantially parallel to the main reference plane 101 and perpendicular to the external surface 5021 of the frame member 502.

The first ports 5020 have preferably an oblong shape and are defined by opposing walls 5022 and 5023. Preferably, the ports 5020 are in the shape of double opposing arches, which allow the ports 5020 to compress and deform axially for absorbing shock and damping vibration. The first ports 5020 are preferably positioned at the ends of the first frame members 501 or, more generally, at the ends of the first cavities 22A and 22B.

Preferably, the axis 5020A of the ports 5020 is coincident with the axis 221A-221B of the cavities 22A-22B.

In this manner, they allow the passage of air from the external environment into the interior of the cavities 22A-22B, despite of the presence of the external rim 502.

As it will be better shown in the following, when using a single tubolar element 502A of composite material to form the frame member 502, a port 5020 may be obtained by a molding process that foresees the insertion of a mold pin through a prepreg mold structure forming the tubolar element 502A.

When using a plurality of tubolar elements 502B-502C of composite material, a port 5020 may be obtained thanks to the insertion of a mold pin between a plurality of prepreg tubes forming the tubolar elements that constitute the frame member 502.

The ports 5020 can be obtained by drilling or cutting techniques when metal or wood are used for the second frame member 502.

The supporting frame 50 preferably comprises one or more third frame members 503 forming the neck portion 13, which can be made of composite materials, plastic materials, metal materials, wood or other suitable materials, according to the needs.

In the embodiments shown in the attached figures, the neck portion 13 is formed by two third frame members 503, which extend parallel to the reference plane 101. The frame members 503 have a common end 131 that joins the handle portion 14 and opposed diverging ends 132 and 133 (FIG. 2) joining the paddle portion 12. Of course, different configurations may be adopted.

As for the frame member 502, the third frame member 503 may comprise a single tubolar element or a plurality of tubolar elements, which are joined together to form an interior common wall.

The third frame members 503 may also comprise second ports 5030 (FIGS. 1-5), similar to the first ports 5020.

The supporting frame 50 may also comprise a fourth frame member 504, which form the handle portion 11 and comprises composite materials, plastic materials, metal materials, wood or other suitable materials, according to the needs As for the frame members 502 and 503, the frame member 504 may be constituted by a single tubolar element or by a plurality of tubular elements that are joined to form an internal common wall.

The paddle portion 12 may also comprise one or more second through cavities 23 having a second longitudinal axis 231 (FIG. 6), which is substantially perpendicular to the main reference plane 101 and the main longitudinal axis 100.

The through cavities 23 mainly allow the passage of air between the two striking surfaces 121A-121B of the paddle portion 12.

The cavities 23 may be obtained both on the core members 501-502 and on the first members 501 of the frame 50 (FIG. 5). Thus, they can communicate with the cavities 22A-22B of the paddle portion 12. The passage of air through the paddle portion 12 may therefore occur along three dimensions, with a further improvements of the racquet aerodynamics.

The through cavities 23 are preferably present in racquets that are addressed to outdoor sports activities. For other kind of racquets, such as table tennis racquets, the second cavities 23 may not be present at all or may have a much smaller section.

Generally, the cavities 23 may be obtained by drilling once the paddle portion 12 is formed. As an alternative, they may be obtained by means of the insertion of pins during a molding process of the paddle portion 12.

The racquet structure 1 may be realized at industrial level by adopting relatively simple and effective molding processes that allow a massive production at competitive costs.

In principle, a large number of variants and options are available depending, for example, on the structural elements and the materials adopted for the racquet structure.

Some options may be fully within the capabilities of the skilled person since they relate to simple techniques of layer superimposition and gluing, specially when more traditional materials such as wood or aluminum are adopted, in particular for the paddle portion 12.

Innovative molding processes may be adopted when the racquet structure 1 comprise a supporting frame 50 with composite materials such as carbon fibers or glass fibers.

Referring to FIGS. 14-15, a manufacturing method for realizing the racquet structure 1 including a frame made of composite materials is schematically described in two possible variants.

Said manufacturing method basically consists of providing in a mold a sandwich structure 710 that is aimed at simultaneously forming the different portions of the racquet structure 1, in particular of the paddle portion 12.

The sandwich structure 710 preferably includes some moldable structures, made of prepreg tubes of composite materials, which are aimed at forming the members 501-504 of the supporting frame 50 and sheets of different materials to form the remaining parts of the racquet structure.

In said manufacturing method, a step of providing in a mold (not shown) one or more sheets 711 and 712 of composite materials (preferably in a not yet reacted or "prepreg" status) to form at least the cover layers 261-262 of the paddle portion 12 is included.

Preferably, the sheets 711 and 712 may be arranged to envelop the entire sandwich structure 710. In this respect, they may also form a single enlarged sheet covering the mould surfaces. The manufacturing method comprises also a step of providing in said mold one or more sheets 713 and 714 made of relatively soft material (such as EVA, PU foam or themoplastic elastomers) to form the core members 251 and 252 of the paddle portion 12. The sheets 713 and 714 are preferably placed internally to the sheets 711 and 712 to form the sandwich structure 710.

The manufacturing method may also comprise a step of providing in said mold one or more first moldable structures 715 to form the first frame members 501. Each of the first moldable structures 715 may comprise a prepreg tube 715A having a pin member 715A (FIG. 14) or an inflatable bladder 715B (FIG. 15) coaxially positioned therein. The first moldable structures 715 are advantageously placed between the sheets 713 and 714 to form the sandwich structure 710.

A further step of the manufacturing method consists of providing in said mold one or more second moldable tube structures 716-717 (FIGS. 14) and 718-719 (FIG. 15) to form the second frame members 502 and/or the third frame members 503 and/or the fourth frame members 504 of the supporting frame 50.

According to a first option, the second moldable structures 716-717 comprises each an external prepreg tube 716A-717A, a first tube region containing a first inflatable bladder 716B-717B, a second tube region containing a second inflatable bladder 716C-717C. At the location where a port 5020 and/or 5030 of the supporting frame 50 is to be formed, at least a prepreg cross channel 716D-717D is provided at an intermediate region of the moldable structure 716-717. A pin member, preferably the pin member 715B itself, is inserted in the cross channels 716D and 717D, so as to keep separated the inflatable bladders 716B-717B and 716C-717C during the inflating and curing of the moldable structure 716-717 and form the ports 5020 and/or 5030.

According to a second option, each of the second moldable structures 718-719 comprises a plurality of adjacent prepreg tubes 718A-718B and 719A-719B, each of said prepreg tubes having an inflatable bladder 718C-718D and 719C-719D axially positioned therein.

At the location where a port 5020 and/or 5030 is to be formed, a pin member 718E-719E is inserted between the prepreg tubes 718A-718B and 719A-719B, so as to keep them separated during the inflating and curing of the moldable structure 716-717 and form the ports 5020 and/or 5030. As a further option (not shown) the single pin member 715A passing through the first moldable structure 715 can be used to this aim as well.

The manufacturing method then comprises the step of pressurizing the inflatable bladders placed in the mold and the step of heating the mold.

In this manner, the prepreg tubes of the mentioned prepreg moldable structures may conform to their definitive shape and cure. At the same time, the remaining layers of the sandwich structure 710 may react.

The pin members 715A, 718E and 719E can be easily removed once the sandwich structure 710 reaches its final consolidation.

Also for the manufacturing method just described, many options and variations may be considered, according to the needs. The number of possible manufacturing step combinations is in practice unlimited if hybrid structures for the racquet frame 50, including composite and metal and/or plastic and/or wood materials, are to be realized.

The racquet structure 1, according to the invention has proven to reach the intended aim and objects.

The provision of the cavities 22A-22B in the paddle portion 12 allows the achievement of a dramatic reduction of the racquet weight and of a decrease of the air resistance during the racquet swinging. This remarkably enhances the user's comfort during the playing activity. The number and layout of the cavities 22A and 22B as well as the number and position of ports on the supporting frame 50 may be easily varied according to the needs. This fact allows an easily tailoring of the physical characteristics of the racquet structure.

The racquet structure 1 appears to be quite innovative also from an aesthetic point of view.

Further, attractive aesthetic solutions may be easily provided by a proper selection of the position of the cavities and/or of the position of frame ports and/or of the materials.

Finally, the racquet structure, according to the invention, may be manufactured at industrial level by means of relatively simple molding processes that can be easily automated for a massive production. This allows the achieving of a remarkable reduction of industrial costs.

The invention claimed is:

1. A sports racquet (1) extending along a main longitudinal axis (100) and a main reference plane (101), said sports racquet comprising a handle portion (11), a paddle portion (12), which is provided with at least a solid ball striking surface (121A,121B), and a neck portion (13), which rigidly connects said handle portion and said paddle portion, characterized in that said paddle portion comprises at least a first cavity (22A, 22B) having a first longitudinal axis (221A, 221B), which is at least substantially coplanar with said main reference plane (101), wherein said at least first cavity (22A, 22B) extends completely through said paddle portion so as to communicate with opposed exterior surfaces of said paddle portion.

2. A sports racquet, according to claim 1, characterized in that said at least a first cavity (22A) extends between a first side section (120) and a second side section (140) of said paddle portion, said first and second side sections being positioned opposite with respect to said main longitudinal axis.

3. A sports racquet, according to claim 2, characterized in that said at least a first cavity (22B) extends between a side section (120, 140) and a tip section (150) of said paddle portion.

4. A sports racquet according to claim 1, characterized in that said at least a first cavity (22A, 22B) is a through cavity, which allows the passage of air between at least two different sections of said paddle portion.

5. A sports racquet according to claim 1, characterized in that said paddle portion comprises a first core member (251) having a first bonding surface (251A) and a second bonding surface (251B), said first bonding surface being bonded to a first cover layer (261) forming a first striking ball surface (121A) of said paddle portion, said second bonding surface (251B) being bonded to a third bonding surface (252B) of a second core member (252) of said paddle portion, said second core member further comprising a fourth bonding surface (252A), said fourth bonding surface being bonded to a second cover layer (262) forming a second striking ball surface (121B) of said paddle portion.

6. A sports racquet, according to claim 5, characterized in that said first core member (251) comprises at least a first shaped wall (253) at said second bonding surface (251B) and in that said second said core member (252) comprises at least a second shaped wall (254) at said third bonding surface (252B), said first shaped wall and said second shaped wall forming said at least a first cavity (22A, 22B) when said first and second core members are bonded together.

7. A sports racquet according to claim 1, characterized in that it comprises a supporting frame (50).

8. A sports racquet, according to claim 7, characterized in that said supporting frame (50) comprises at least a first hollow frame member (501) extending at least partially through said paddle portion and forming said at least a first cavity (22A, 22B).

9. A sports racquet according to claim 8, characterized in that said at least a first frame port is positioned at one end of said first hollow frame member.

10. A sports racquet according to claim 8, characterized in that said supporting frame (50) comprises at least a second frame member (502) defining an external rim, which contours at least partially said paddle portion.

11. A sports racquet according to claim 7, characterized in that said supporting frame (50) comprises at least a second frame member (502) defining an external rim, which contours at least partially said paddle portion.

12. A sports racquet according to claim 11, characterized in that at least a second frame member comprises a single tubular element (502A).

13. A sports racquet according to claim 11, characterized in that said at least a second frame member comprises two or more tubular elements (502B, 502C), which are joined together to form a common wall (502D), which is interior to said at least a second frame member (502).

14. A sports racquet according to claim 11, characterized in that said second frame member is provided with at least a first frame port (5020).

15. A sports racquet according to claim 14, characterized in that said at least a first frame port is positioned at one end of said first hollow frame member.

16. A sports racquet according to claim 1, characterized in that said paddle portion comprises at least a second cavity (23) having a second longitudinal axis (231), which that is substantially perpendicular to said main reference plane (101).

17. A sports racquet according to claim 1, characterized in that said at least a first cavity (22A, 22B) has a first longitudinal axis (221A, 221B) that is substantially parallel to said main reference plane (101).

* * * * *